US011867031B2

(12) United States Patent
Jones et al.

(10) Patent No.: US 11,867,031 B2
(45) Date of Patent: Jan. 9, 2024

(54) SAND REMOVAL SYSTEM

(71) Applicant: Tenax Energy Solutions, LLC, Clinton, OK (US)

(72) Inventors: Kevin Dewayne Jones, Clinton, OK (US); Jeremy W. Butler, Dill City, OK (US)

(73) Assignee: Tenax Energy Solutions, LLC, Clinton, OK (US)

( * ) Notice: Subject to any disclaimer, the term of this patent is extended or adjusted under 35 U.S.C. 154(b) by 0 days.

(21) Appl. No.: 17/860,243

(22) Filed: Jul. 8, 2022

(65) Prior Publication Data

US 2023/0045379 A1 Feb. 9, 2023

Related U.S. Application Data

(60) Provisional application No. 63/222,684, filed on Jul. 16, 2021.

(51) Int. Cl.

| | |
|---|---|
| ***E21B 43/04*** | (2006.01) |
| ***E21B 34/10*** | (2006.01) |
| ***E21B 43/10*** | (2006.01) |
| ***E21B 37/10*** | (2006.01) |

(52) U.S. Cl.

CPC ..... *E21B 43/04* (2013.01); *E21B 34/10* (2013.01); *E21B 37/10* (2013.01); *E21B 43/10* (2013.01); *E21B 2200/02* (2020.05)

(58) Field of Classification Search

CPC ..... E21B 43/12; E21B 43/10; E21B 34/142; E21B 34/14; E21B 23/001; E21B 7/046; E21B 27/00

See application file for complete search history.

(56) References Cited

U.S. PATENT DOCUMENTS

| | | | | | |
|---|---|---|---|---|---|
| 2,150,406 | A * | 3/1939 | Taylor | E21B 37/08 | 166/119 |
| 2,907,391 | A * | 10/1959 | Kinley | E21B 34/14 | 166/331 |
| 4,553,599 | A * | 11/1985 | Glotin | E21B 47/06 | 166/316 |
| 5,107,927 | A * | 4/1992 | Whiteley | E21B 17/10 | 166/227 |
| 11,506,016 | B2 * | 11/2022 | AlAdawy | F16K 31/12 | |
| 2008/0041581 | A1 * | 2/2008 | Richards | E21B 34/08 | 166/193 |
| 2013/0014956 | A1 * | 1/2013 | Hughes | E21B 34/12 | 166/373 |
| 2015/0013978 | A1 * | 1/2015 | Nenniger | E21B 43/2406 | 166/321 |
| 2018/0003010 | A1 * | 1/2018 | Davis | E21B 43/08 | |
| 2019/0360289 | A1 * | 11/2019 | Jones | B08B 9/032 | |
| 2022/0195859 | A1 * | 6/2022 | Laing | B01F 23/2319 | |

* cited by examiner

*Primary Examiner* — Shane Bomar

(74) *Attorney, Agent, or Firm* — Tomlinson McKinstry, P.C.

(57) ABSTRACT

A sand removal system configured to remove sand from a casing installed within a producing wellbore. The system utilizes a bottom hole assembly comprising a check valve sub and at least one sand removal tool. A swab cup installed within a vertical section the casing is used to create a pressure differential around the bottom hole assembly, causing fluid and sand to flow at a high velocity into the sand removal tool. The sand is caused to flow upstream where is later removed from the wellbore.

19 Claims, 12 Drawing Sheets

SAND REMOVAL SYSTEM

RELATED APPLICATIONS

This application claims the benefit of provisional patent application Ser. No. 63/222,684, authored by Jones et al. and filed on Jul. 16, 2021, the entire contents of which are incorporated herein by reference.

SUMMARY

The present invention is directed to a downhole tool. The downhole tool comprises an elongate tubular body having a plurality of perforations formed therein. The plurality of perforations are positioned throughout a length of the body. The downhole tool further comprises an elongate flow guide installed within the body and movable relative to the body. The flow guide comprises a flow restriction element and an elongate rod. The flow restriction element is sized to obstruct communication between at least some of the plurality of perforations and an interior of the body. The rod is installed within the flow restriction element and is made of a heavier material than that of the flow restriction element.

The present invention is also directed to a method of using a system. The system comprises a cased wellbore positioned beneath a ground surface. A least a portion of the cased wellbore contains a mixture of fluid and sand. The system also comprises a tubular string and a downhole tool. The tubular string is installed within the cased wellbore and has an upstream end and a downstream end. At least a portion of the tubular string contains fluid. The downhole tool is attached to a downstream end of the tubular string and is submerged within the mixture of fluid and sand within the cased wellbore. The downhole tool comprises an elongate tubular body having a plurality of perforations formed therein. The perforations are positioned throughout a length of the body.

The system further comprises a check valve and a swab cup. The check valve is incorporated into the tubular string and positioned upstream from the downhole tool. The swap cup is attached to a line and is installed within the tubular string.

The method of using the system comprises the steps of submerging the swab cup within fluid contained within the tubular string and pulling the swab cup towards the ground surface using the line. The method also comprises the steps of causing the mixture of fluid and sand to flow through one or more of the plurality of perforations and into the interior of the body of the downhole tool and causing mixture of fluid and sand to flow through the check valve. The method further comprises the step of retaining the sand within the tubular string and upstream from the check valve.

DETAILED DESCRIPTION

Figure 1:
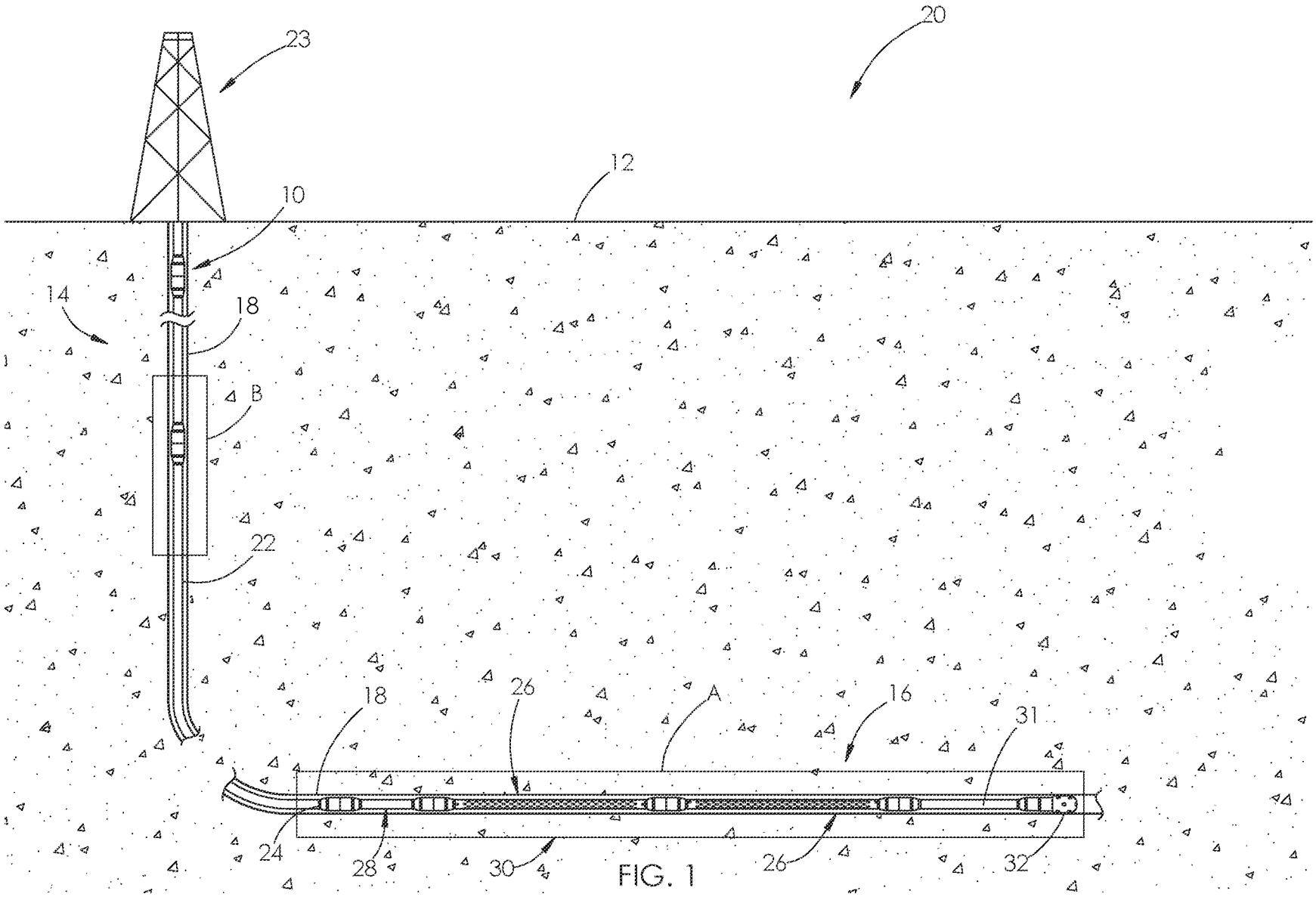
FIG. 1 is an illustration of a wellbore having a sand removal system installed therein.

Turning to FIG. 1, a producing wellbore 10 is shown formed beneath a ground surface 12. The wellbore 10 has a vertical section 14 that turns into a horizontal section 16. A casing 18 is installed throughout the length of the wellbore 10 to prevent the walls of the bore 10 from collapsing. Subterranean fluid from the rock formation surrounding the horizontal section 16 flows into the casing 18 through a plurality of perforations (not shown) created in the casing 18 during hydraulic fracking operations. The subterranean fluid may be crude oil, natural gas, or a mixture of both.

The pressure applied to the subterranean fluid entering the casing 18 may not be high enough to force the fluid to flow to the ground surface 12. In such case, a tubular production string (not shown) may be installed within the casing 18. The production string draws fluid trapped within the casing 18 to the ground surface 12. In some cases, sand or other flowable solid materials (collectively referred to herein as "sand") may accumulate within the horizontal section 16 of the casing 18, obstructing the flow of subterranean fluid into the production string. The present disclosure is directed to a sand removal system 20, shown in FIG. 1, configured to remove the sand from the casing 18, thereby increasing the flow and recovery of subterranean fluid from the wellbore 10.

Continuing with FIG. 1, if the flow of subterranean fluid into the production string is restricted by sand, the production string is pulled from the casing 18 and replaced with a tubular workover string 22. One or more downhole tools used with the system 20 are attached to a downstream end 24 of the string 22. The workover string 22 may comprise jointed pipe or coiled tubing. The workover string 22 may also comprises one or more sections of the production string originally installed within the casing 18. The workover string 22 is supported at the ground surface 12 by a top drive 23. In alternative embodiments, the workover string 22 may be supported at the ground surface 12 by other support mechanisms known in the art.

Figure 2:
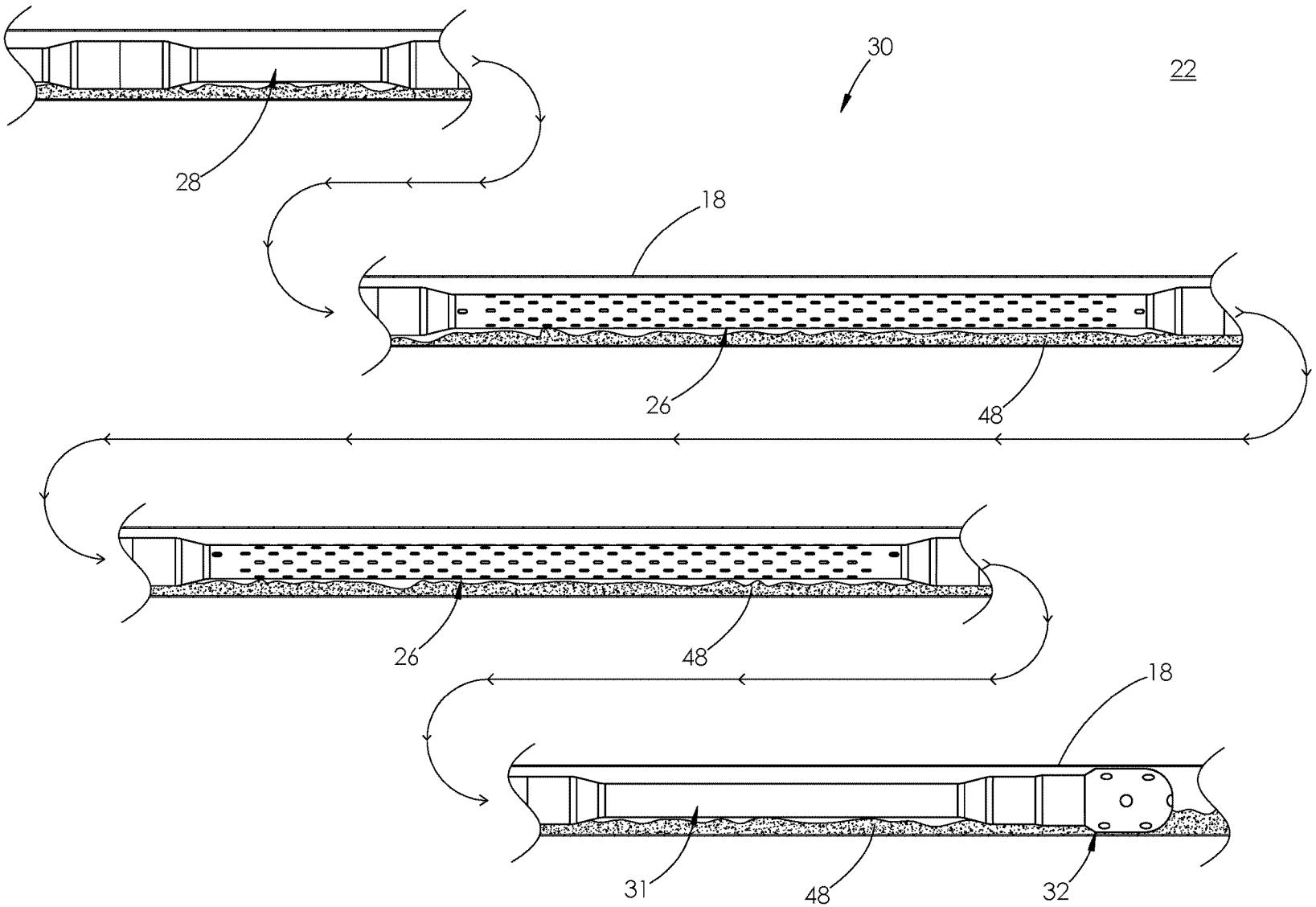
FIG. 2 is an enlarged view of the bottom hole assembly shown in area A in FIG. 1. Breaks are used to facilitate display of the assembly on a single page.

With reference to FIGS. 1 and 2, the downhole tools used with the system 20 comprise at least one sand removal tool 26 and a check valve sub 28. Collectively, the downhole tools are referred to as a bottom hole assembly 30. The bottom hole assembly 30 may comprises a plurality of the sand removal tools 26. For example, two sand removal tools 26 are shown in FIGS. 1 and 2. The check valve sub 28 is positioned upstream from the sand removal tool 26 within the bottom hole assembly 30. While not required as part of the system 20, the bottom hole assembly 30 may further comprise a wash nozzle 32 or other downhole tools, such as a drill bit, positioned downstream from the sand removal tool 26. The wash nozzle 32 is attached to the sand removal tool 26 using an adapter sub 31.

Figure 3:
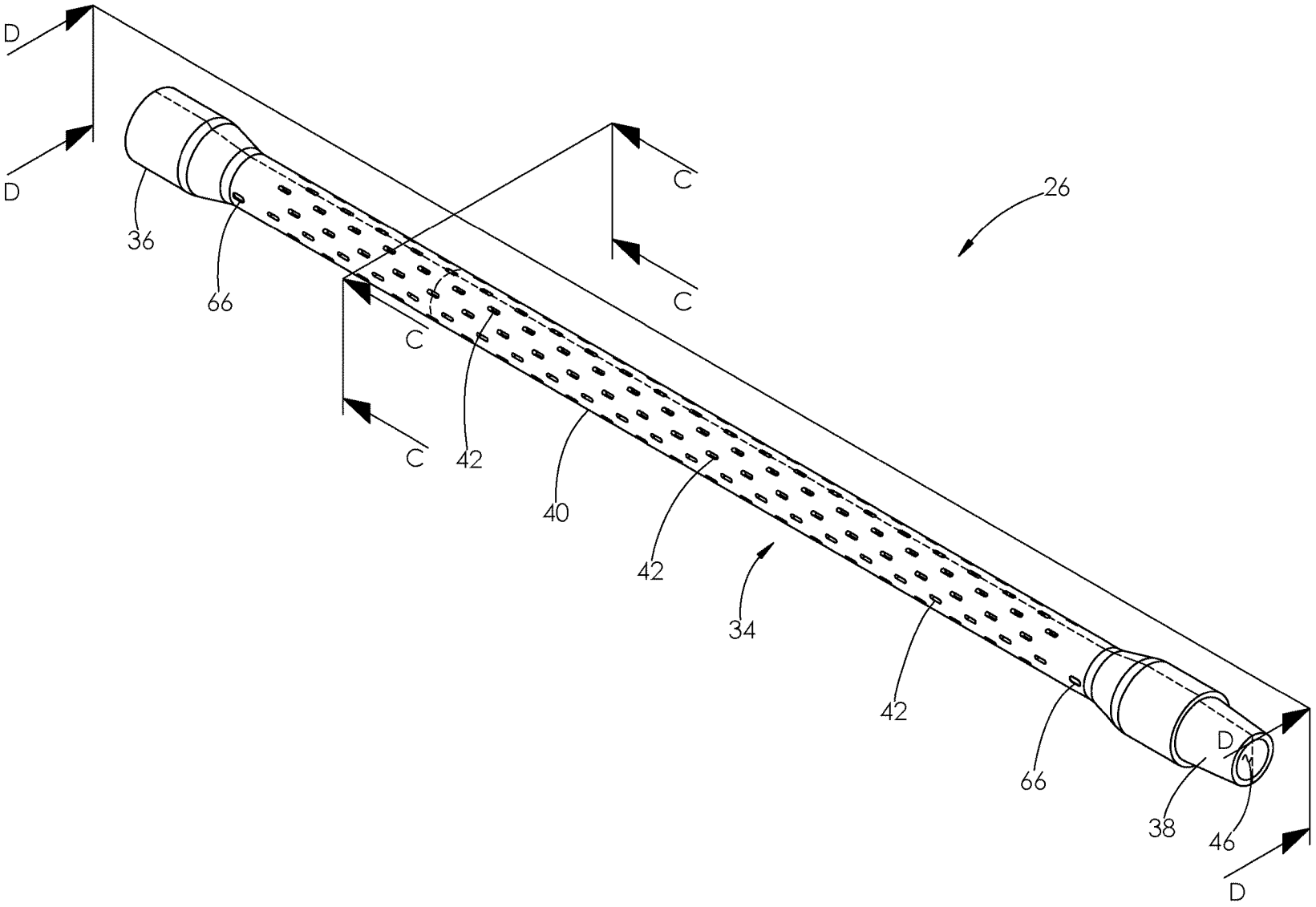
FIG. 3 is a perspective view of one of the sand removal tools shown in FIG. 2.
Figure 4:
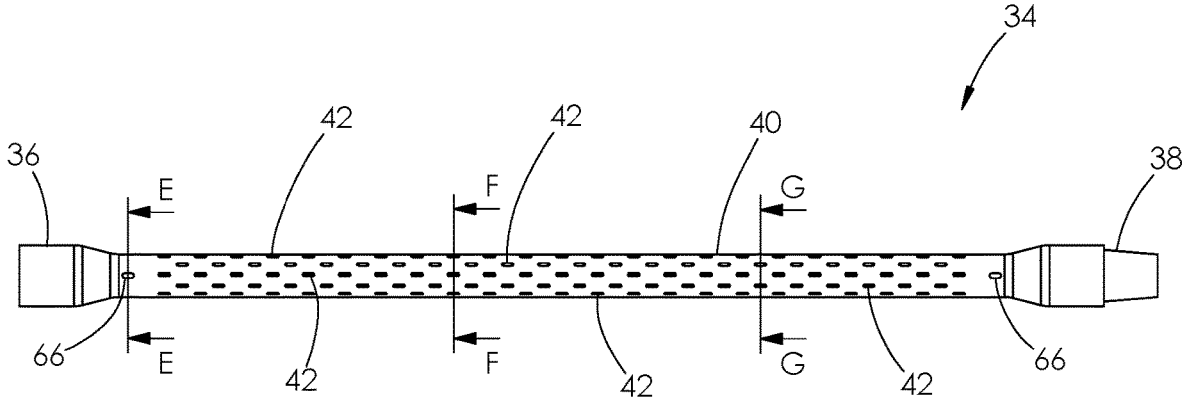
FIG. 4 is a top plan view of a body of the sand removal tool shown in FIG. 3.

Turning to FIGS. 3 and 4, the sand removal tool 26 comprises an elongate tubular body 34 having opposed upstream and downstream connection ends 36 and 38 joined by an elongate intermediate section 40. The connection ends 36 and 38 may comprise threads configured for mating with adjacent subs or tools. For example, the upstream connection end 36 may comprise a threaded box, and the downstream connection end 38 may comprise a threaded pin.

Figure 5:
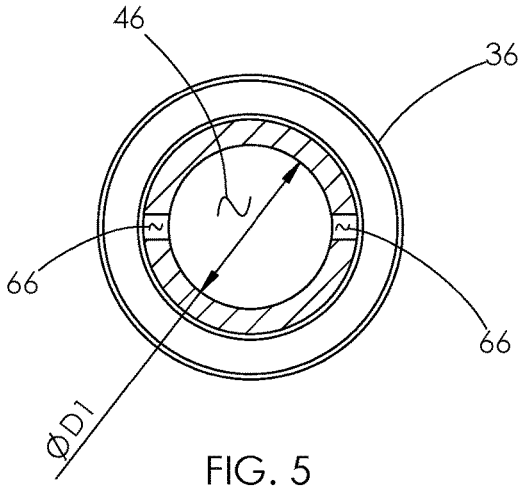
FIG. 5 is a cross-sectional view of the body shown in FIG. 4, taken along line E-E.
Figure 6:
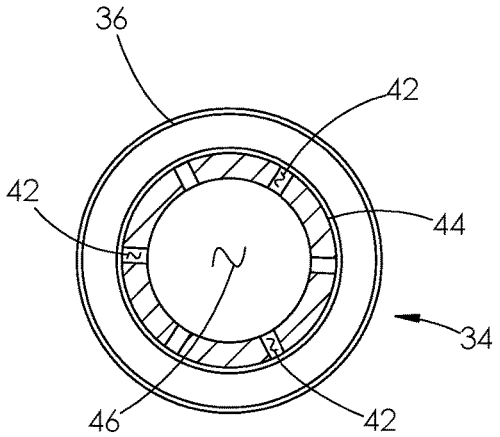
FIG. 6 is a cross-sectional view of the body shown in FIG. 4, taken along line F-F.
Figure 7:
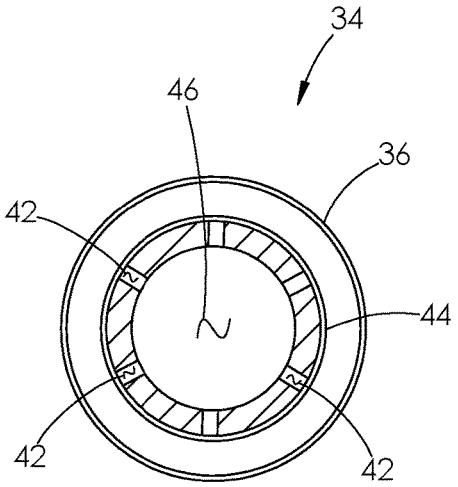
FIG. 7 is a cross-sectional view of the body shown in FIG. 4, taken along line G-G.

With reference to FIGS. 3-7, a plurality of perforations 42 are formed in the intermediate section 40 of the body 34 and are positioned throughout a length of the intermediate section 40, as shown in FIGS. 3 and 4. Each perforation 42 interconnects an external surface 44 of the body 34 with a hollow interior 46 of the body 34, as shown in FIGS. 6 and 7. The interior 46 of the body 34 has an inner diameter, $D_1$, as shown in FIG. 5. The plurality of perforations 42 are each large enough to allow sand 48 to flow therethrough, but small enough to restrict any larger debris from entering the body 34. Collectively, the perforations 42 function as a perforated screen formed throughout a length of the body 34. The perforations 42 shown in FIGS. 3 and 4 each have a rectangular shape. In alternative embodiments, the perforations 42 may have different shapes, such a circular or oval cross-sectional shape.

Figure 8:
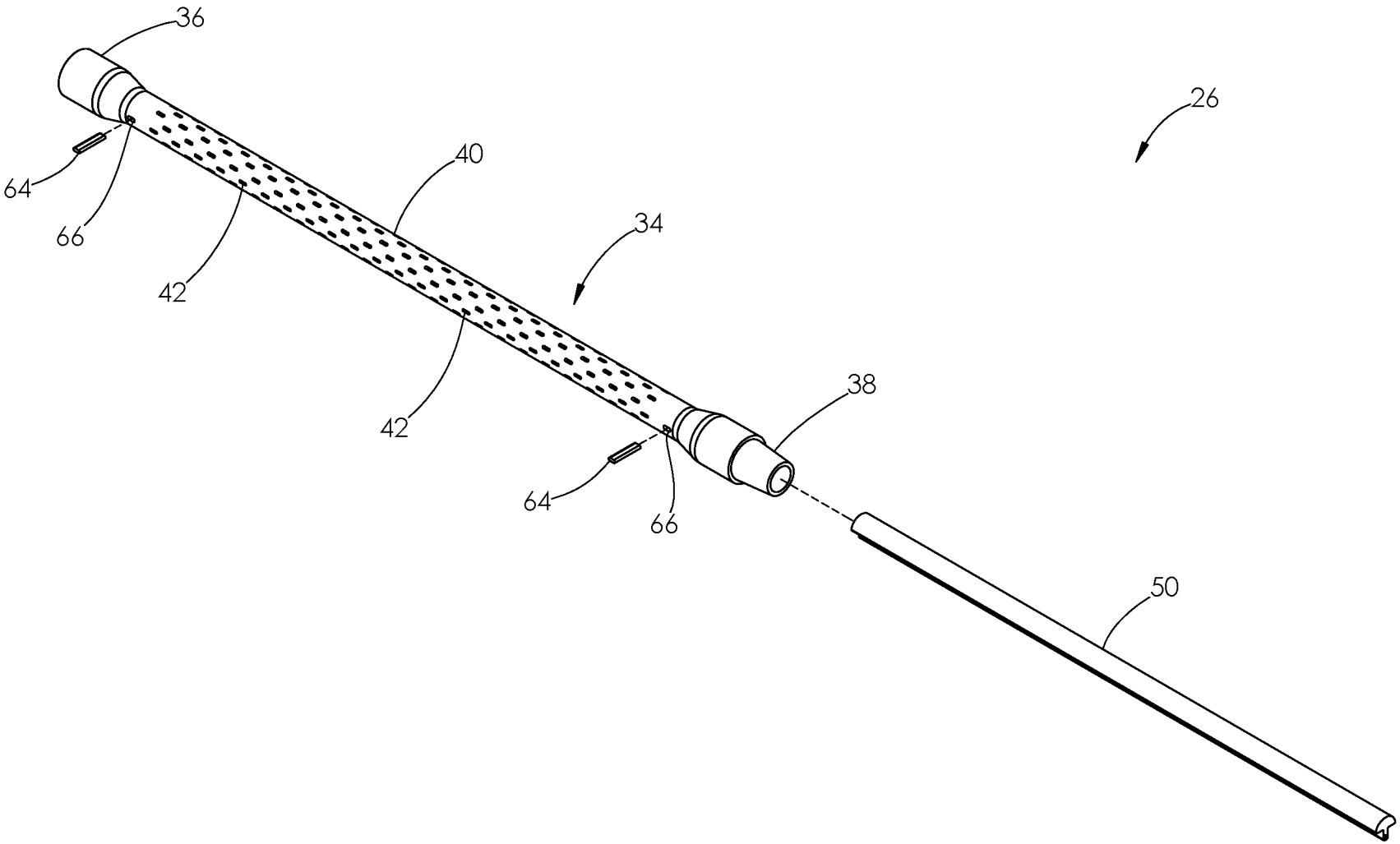
FIG. 8 is an exploded view of the sand removal tool shown in FIG. 3.
Figure 9:
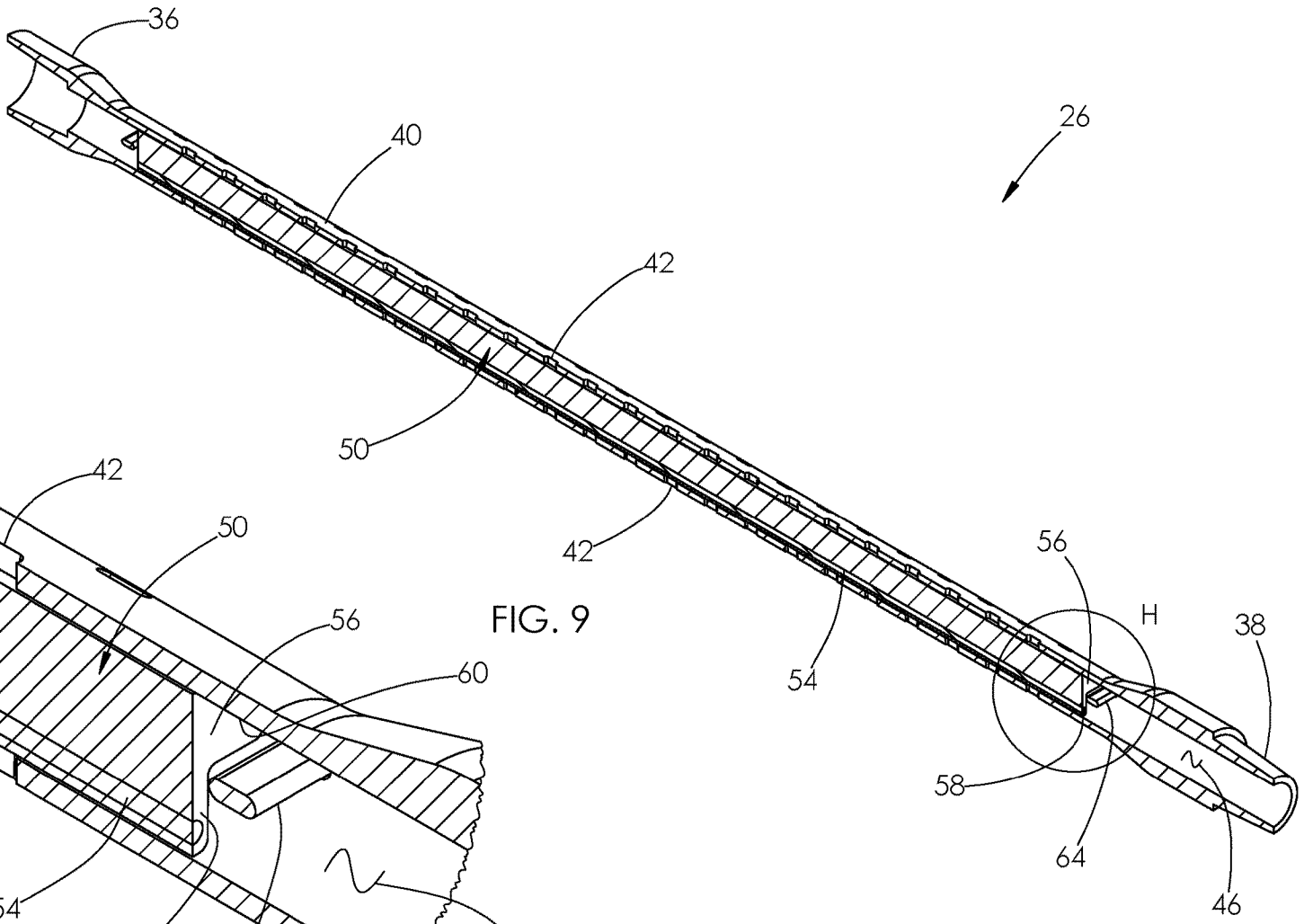
FIG. 9 is a perspective cross-sectional view of the sand removal tool shown in FIG. 3, taken along line D-D.

Turning to FIGS. 8 and 9, the sand removal tool 26 further comprises an elongate flow guide 50 installed within the intermediate section 40 of the body 34. The flow guide 50 has a length that is the same or slightly shorter than a length of the intermediate section 40 such that the flow guide 50 extends entirely or almost entirely between the connection ends 36 and 38, as shown in FIG. 9.

With reference to FIGS. 5 and 8-10, the flow guide 50 is retained within the intermediate section 40 of the body 34 by a pair of retainers 64 positioned at opposite ends of the intermediate section 40. Each retainer 64 has a rectangular shape and is installed within a pair of aligned openings 66 formed within the body 34 immediately adjacent one of the connection ends 36 or 38, as shown in FIG. 5. The retainers 64 may be welded or otherwise secured within the openings 66 formed in the body 34. A small space may exist between the flow guide 50 and each retainer 64 such that the flow guide 50 is movable relative to the retainers 64 but abuts a retainer 64 if moved too far in either direction.

Figure 10:
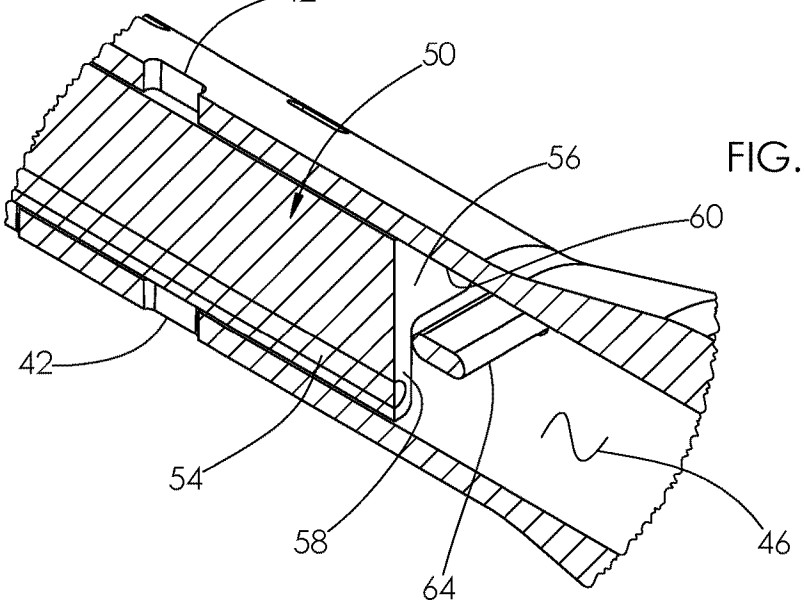
FIG. 10 is an enlarged view of area H shown in FIG. 9.
Figure 13:
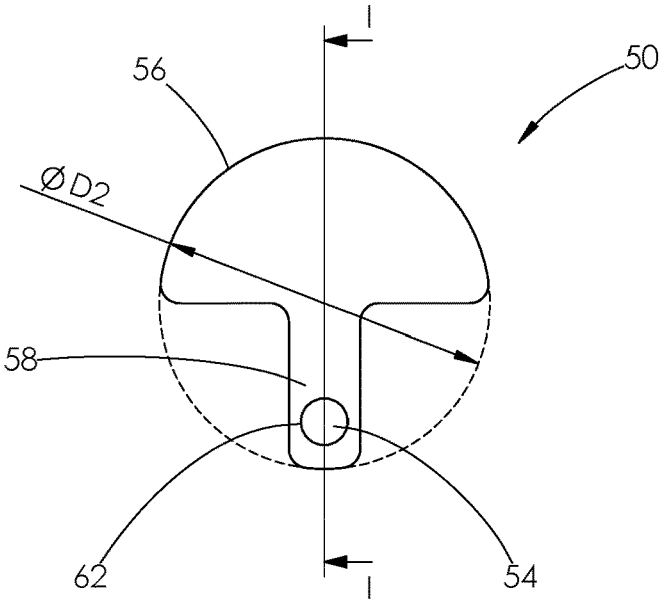
FIG. 13 is a front elevational view of the flow guide shown in FIG. 12.
Figure 14:
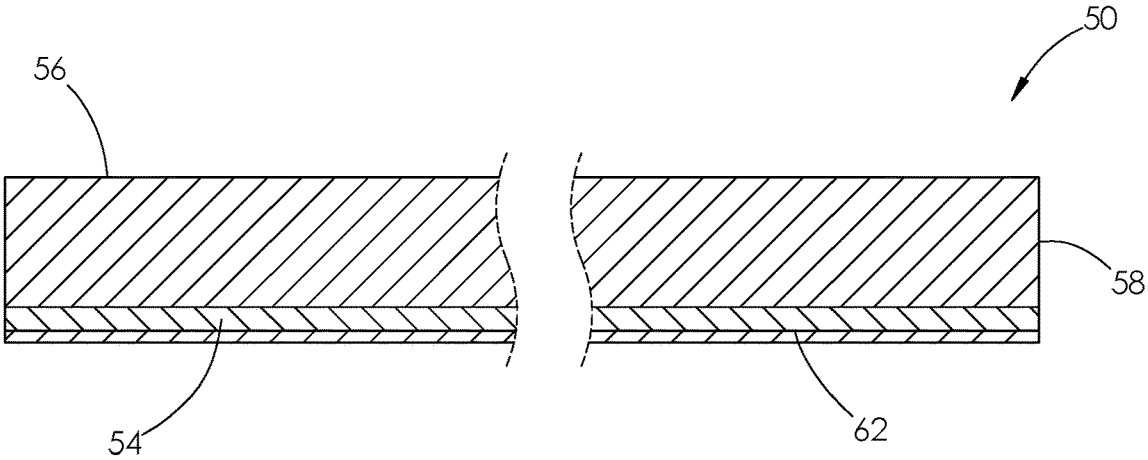
FIG. 14 is a cross-sectional view of the flow guide shown in FIG. 13, taken along line I-I.

With reference to FIGS. 9-14, the flow guide 50 comprises a flow restriction element 52 having an elongate rod 54 installed therein. The flow restriction element 52 comprises a head 56 supported on a neck 58, as shown in FIG. 13. The head 56 has a semi-circular cross-sectional shape and has an outer diameter, $D_2$. The neck 58 extends to the diameter, $D_2$ of the head 56 and is rounded to the same diameter as the head 56. The diameter $D_2$ is slightly smaller than the diameter $D_1$ such that the flow restriction element 52 is rotatable relative to the body 34 but closely faces an inner surface 60 of the body 34, as shown in FIG. 10.

Figure 11:
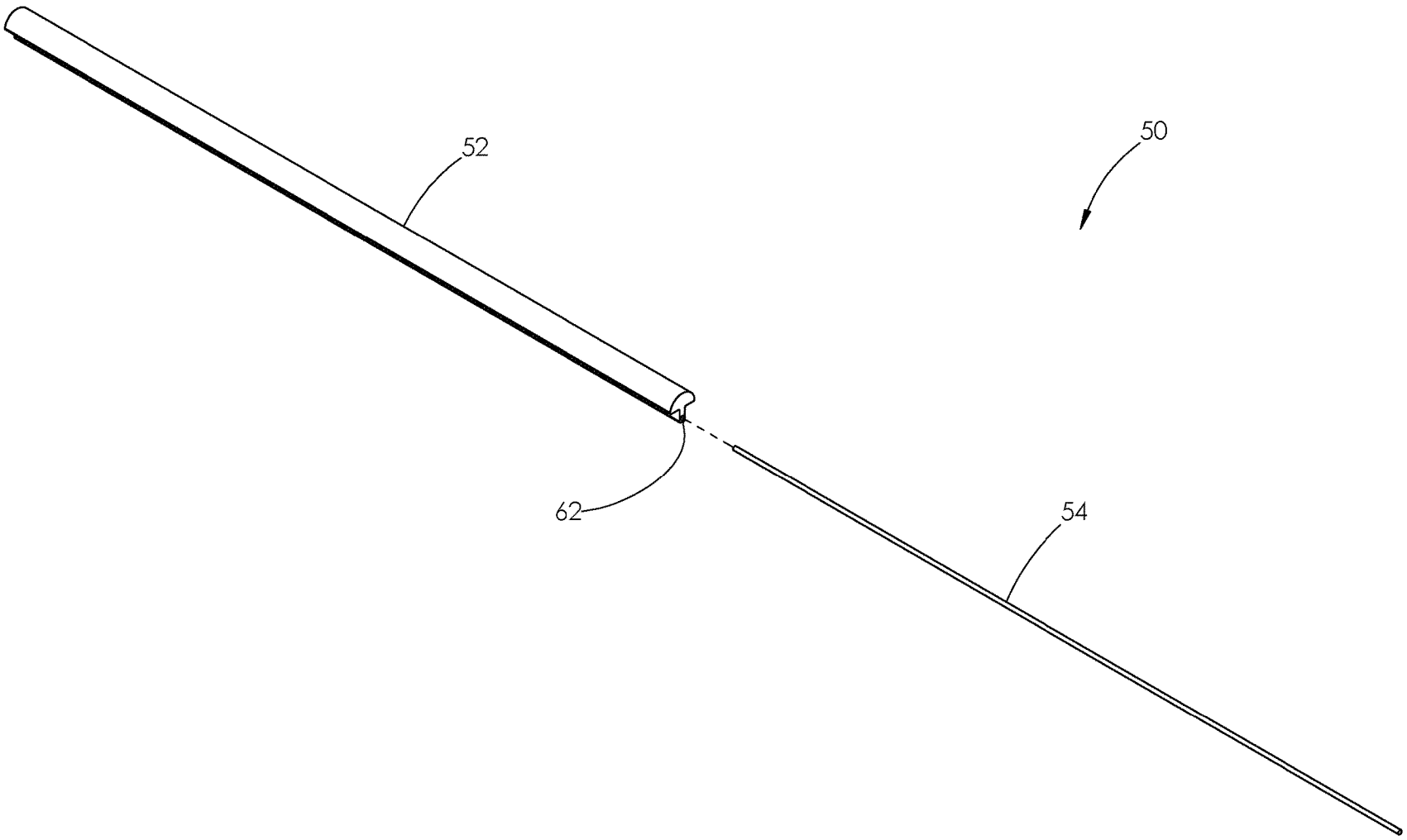
FIG. 11 is an exploded view of the flow guide shown in FIGS. 8 and 9.
Figure 12:
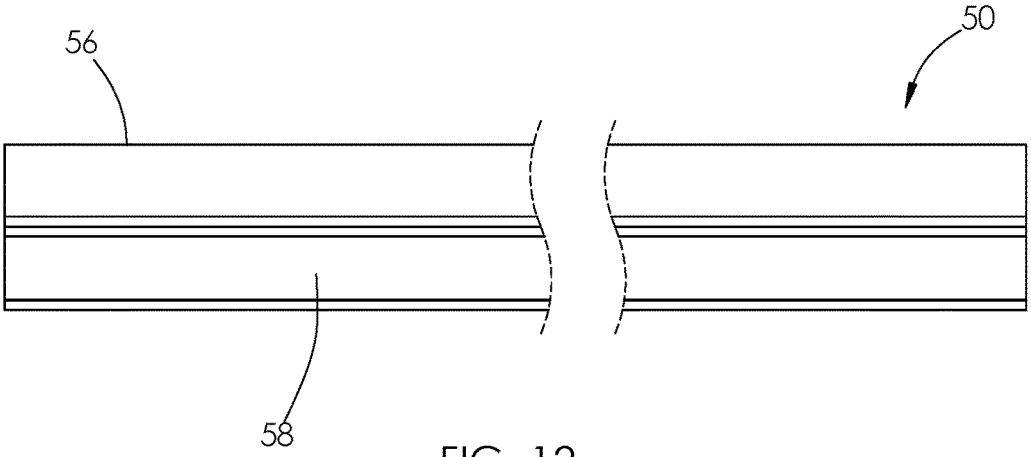
FIG. 12 is a side elevational view of the flow guide shown in FIGS. 8 and 9.

Continuing with FIGS. 9-14, the elongate rod 54 is installed within an elongate passage 62 formed within a lower end of the neck 58, as shown in FIGS. 11 and 13. The rod 54 has the same or close to the same length as the flow restriction element 52, as shown in FIG. 9. The rod 54 may be interference fit within the passage 62 to secure the rod 54 to the neck 58. Alternatively, the rod 54 may be welded within the passage 62 or secured to the neck 58 using fasteners.

Continuing with FIGS. 9 and 10, the flow restriction element 52 is made of a material that causes the element 52 to float when in fluid, such as drilling fluid. Specifically, the flow restriction element 52 is made of a material that has a specific gravity or density less than that of drilling fluid. For example, the flow restriction element 52 may be made of nylon or plastic. When the sand removal tool 26 is submerged in fluid, the flow restriction element 52 floats within the interior 46 of the body 34 and is movable and rotatable relative to the body 34.

In contrast, the rod 54 is made of a heavier material than that of the flow restriction element 52 such that it sinks when in fluid. Specifically, the rod 54 is made of a material that has as specific gravity or density greater than that of drilling fluid. For example, the rod 54 may be made of metal, such as stainless steel. When the rod 54 is installed within the neck 58 of the flow restriction element 52, the neck 58 becomes less buoyant than the head 56 of the flow restriction element 52.

Figure 21:
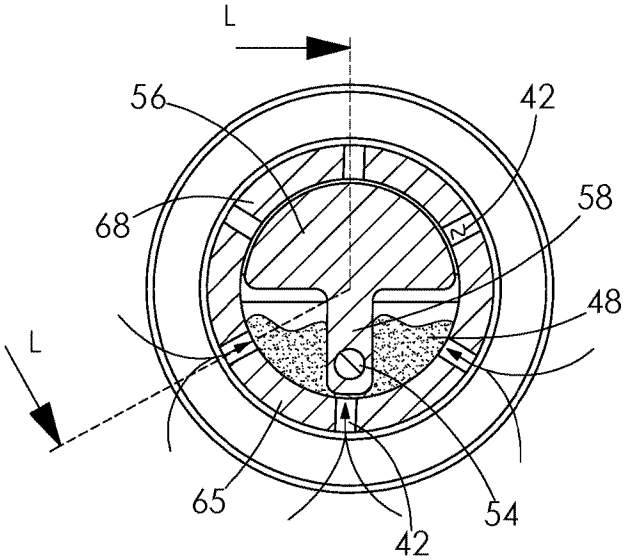
FIG. 21 is a cross-sectional view of the sand removal tool shown in FIG. 3, taken along line C-C, but with sand contained therein.

With reference to FIGS. 9, 10, and 21, when the sand removal tool 26 is submerged in fluid within the casing 18, gravity causes the less buoyant rod 54 to bias the neck 58 towards a bottom portion 65 of the intermediate section 40 and bias the head 56 towards a top portion 68 of the intermediate section 40, as shown in FIG. 21. When in this orientation, the head 56 restricts the flow of fluid through the perforations 42 positioned at the top portion 68 of the intermediate section 40. As will be explained in more detail herein, restricting fluid flow through some of the perforations 42 increases the velocity of fluid flow through the unrestricted perforations 42.

Figure 15:
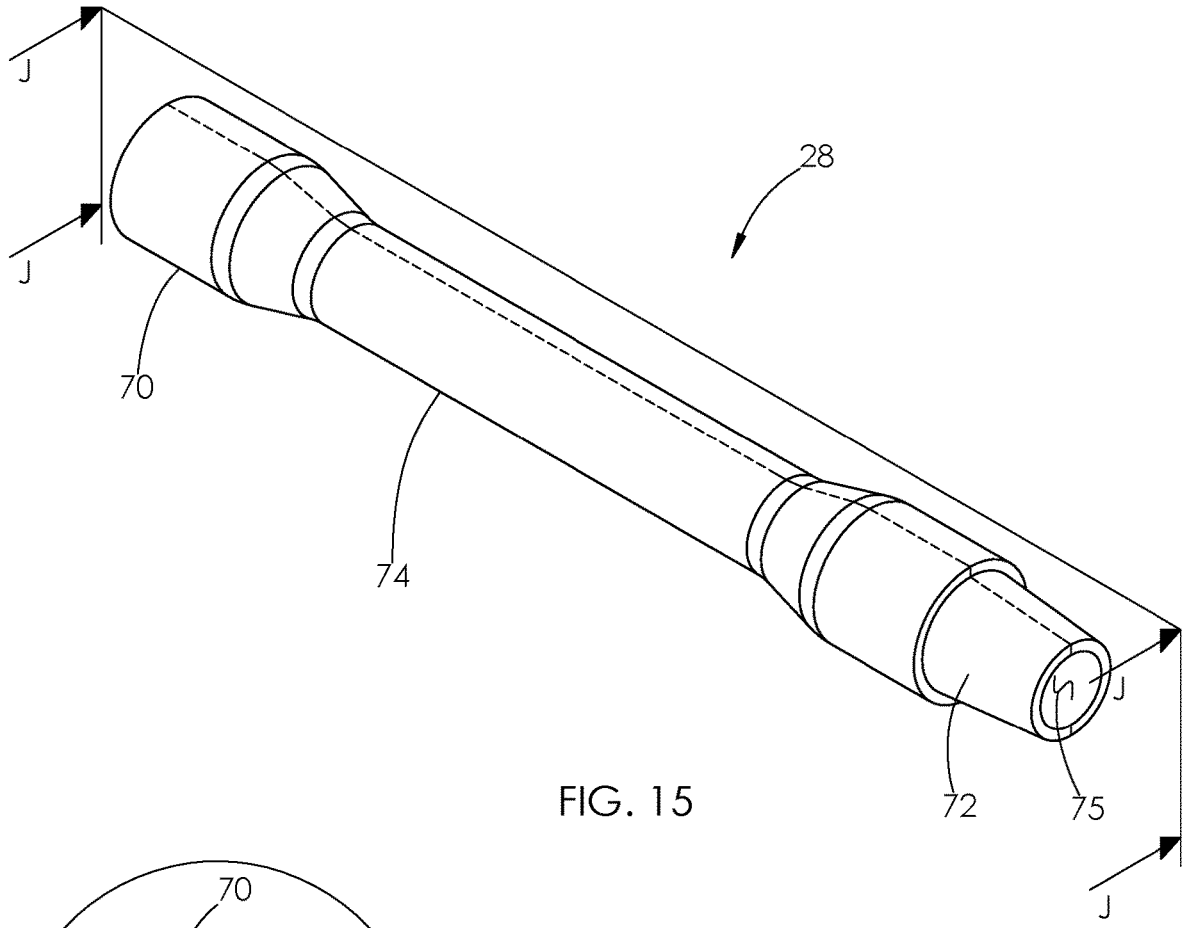
FIG. 15 is a perspective view of the check valve sub shown in FIG. 2.
Figure 16:
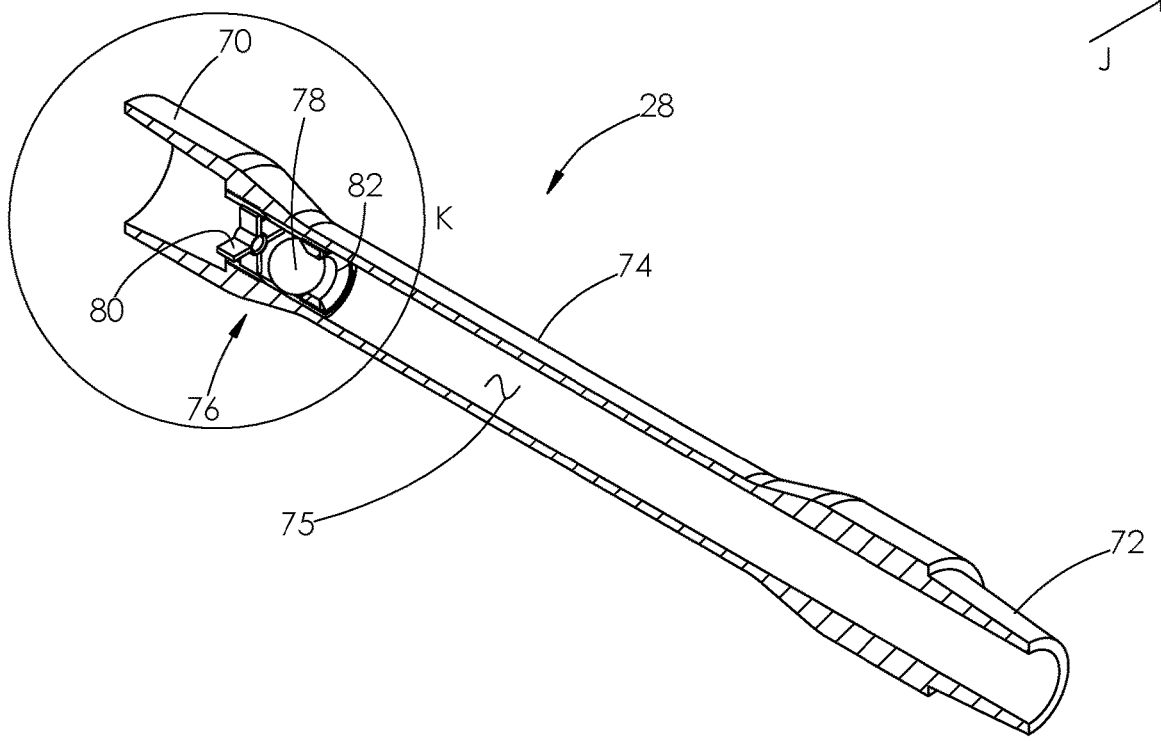
FIG. 16 is a perspective cross-sectional view of the check valve sub shown in FIG. 15, taken along line J-J.

With reference to FIGS. 3, 15, and 16, the check valve sub 28 is attached to the downstream end 24 of the string 22 and the upstream connection end 36 of the sand removal tool 26, as shown in FIG. 3. If more than one sand removal tool 26 is used, the check valve sub 28 is attached to the upstream connection end 36 of the most upstream tool 26, as shown in FIG. 1. One or more tubular pipe sections or downhole tools may be positioned between the check valve sub 28 and the sand removal tool 26, if needed. The check valve sub 28 comprises opposed upstream and downstream connection ends 70 and 72 joined by an elongate tubular body 74 having a hollow interior 75. Like the sand removal tool 26, the connection ends 70 and 72 may comprise threads for mating with adjacent connection ends.

Figure 17:
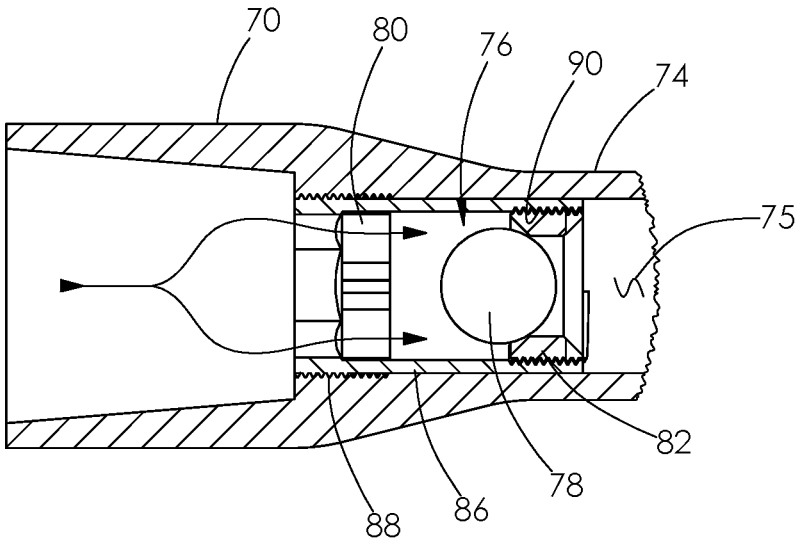
FIG. 17 is an enlarged and plan view of the area K shown in FIG. 16, with the check valve is shown in a closed position.
Figure 18:
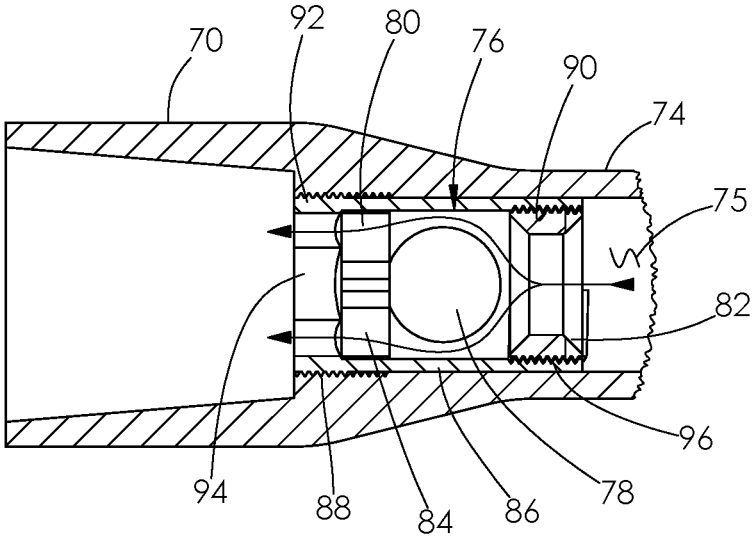
FIG. 18 is the enlarged view shown in FIG. 17, but the check valve is shown in an open position.

With reference to FIGS. 16-18, a check valve 76 is installed within the body 74 of the check valve sub 28 adjacent the upstream connection end 70, as shown in FIG. 16. The check valve 76 comprises a ball 78 positioned between a retainer 80 and a seat 82. The ball 78 is movable between open and closed positions. When in the open position, the ball 78 is spaced from the seat 82, thereby allowing fluid to flow through the seat 82 and around the ball 78, as shown in FIG. 18. When in the closed positioned, the ball 78 is seated on the seat 82, thereby blocking fluid from flowing around the ball 78 and through the seat 82, as shown in FIG. 17. The check valve 76 is oriented such that fluid flowing upstream pushes the ball 78 away from the seat 82, opening the valve 76. In contrast, fluid flowing downstream pushes the ball 78 against the seat 82, closing the valve 76.

Continuing with FIGS. 16 and 18, upstream movement of the ball 78 when in the open position is prevented by the retainer 80, as shown in FIG. 18. The retainer 80 spans the diameter of the check valve 76 and comprises a plurality of fluid ports 84 sized to permit the flow of fluid and sand, but not the ball 78, therethrough, as shown in FIG. 16. The retainer 80 has the general cross-sectional shape of an "x". In alternative embodiments, the retainer 80 may have different shapes as long as it comprises flow ports and stops movement of the ball 78.

Continuing with FIGS. 17 and 18, the check valve 76 is supported within a sleeve 86. External threads 88 are formed in an outer surface of an upstream end of the sleeve 86, and internal threads 90 are formed in an inner surface of a downstream end of the sleeve 86. The external threads 88 are configured to mate with internal threads 92 formed in the inner walls of the body 74 of the check valve sub 28. The sleeve 86 further comprises hex shaped walls 94 formed in its inner surface upstream from the retainer 80. The hex-shaped walls 94 are configured to mate with a tool used to thread the sleeve 86 into the check valve sub 28.

Continuing with FIGS. 17 and 18, the internal threads 90 are configured to mate with external threads 96 formed in an outer surface of the seat 82. The retainer 80 is interference fit within the sleeve 86 upstream from and in a spaced relationship with the seat 82. In alternative embodiments, the check valve 76 may comprise other constructions known in the art or other methods known in the art of installing the check valve 76 within the sub 28. In further alternative embodiments, other types of valves known in the art may be used instead of the ball valve shown in the figures.

Figure 19:
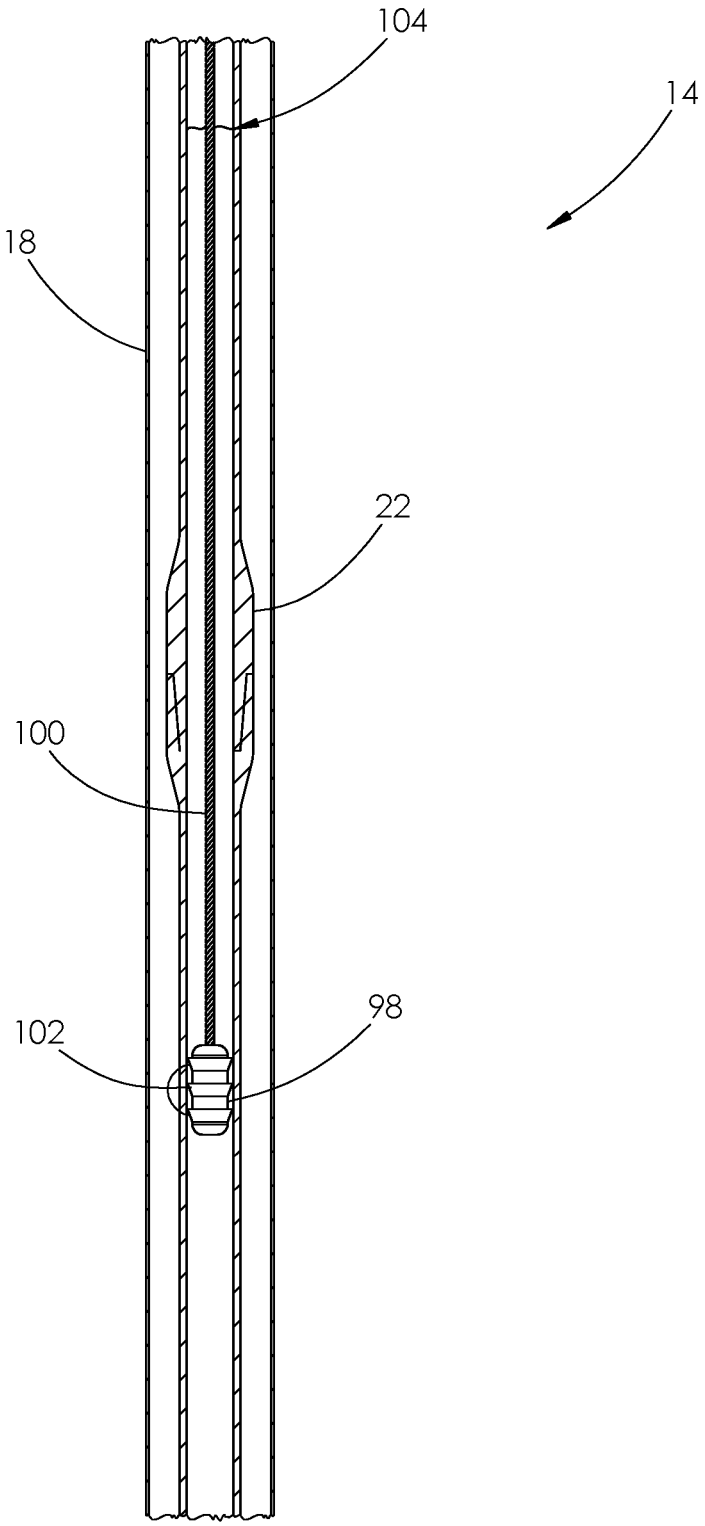
FIG. 19 is an enlarged view of area B shown in FIG. 1, but portions of the casing and tubular string have been cut-away to expose the components installed therein.

Turning to FIG. 19, the sand removal system 20 further comprises a swab cup 98 of the type known in the art. In operation, the swab cup 98 is suspended from a cable or line 100 within the casing 18. The line 100 is typically controlled by a winch at the ground surface 12. The swab cup 98 is made of a rubber material, but also comprises one or more weights. An outer surface of the swab cup 98 is sized to provide clearance between the swab cup 98 and the walls of the string 22 so that the cup 98 may be lowered down the string 22 to a desired depth. The outer surface of the swab cup 98 is also sized so that it engages the walls of the string 22 upon upstream movement of the line 100 and swab cup 98. For example, the outer surface of the swab cup 98 shown in FIG. 19 comprises a plurality of tapered lips 102 configured to tightly engage the walls of the string 22 when moving upstream.

Turning back to FIG. 1, after the bottom hole assembly 30 is attached to the downstream end 24 of the string 22, the bottom hole assembly 30 is lowered down the casing 18 to the horizontal section 16 of the wellbore 10. The wash nozzle 32 or drill bit, if used, may clear any debris obstructing travel of the bottom hole assembly 30 as it is lowered down the casing 18. Eventually, the bottom hole assembly 30 is lowered far enough to be submerged below the fluid level within the casing 18. The fluid will be a combination of drilling fluid, if used, and the fluid produced by the well, which could be oil, natural gas, salt water, water, or other liquids.

Continuing with FIG. 1, once the bottom hole assembly 30 is below the fluid level within the casing 18, fluid will begin to flow through the perforations 42 and into the interior 46 of the sand removal tool 26. Fluid within the interior 46 of the tool 26 will flow upstream through the check valve 76 until the level of fluid within the casing 18 equalizes with the level of fluid within the string 22. To make use of the sand removal system 20, the fluid level must rise high enough to fill at least a portion of the vertical section 14 of the string 22. If the fluid level within the string 22 and/or casing 18 is not high enough to make use of the system 20, drilling fluid may be pumped down the string 22 and/or the casing 18 until the desired fluid level is reached.

Continuing with FIGS. 2 and 19-21, once the bottom hole assembly 30 is at a desired position and the fluid level is high enough, the swab cup 98 is lowered down the string 22 by the line 100. The swab cup 98 is lowered until it is positioned well below the fluid level within the vertical section 14 of the casing 18, as shown for example by a fluid level 104 in FIG. 19. Once the swab cup 98 is at the desired position, the line 100 is rapidly retracted from the casing 18, pulling the swab cup 98 upstream within the string 22.

Figure 20:
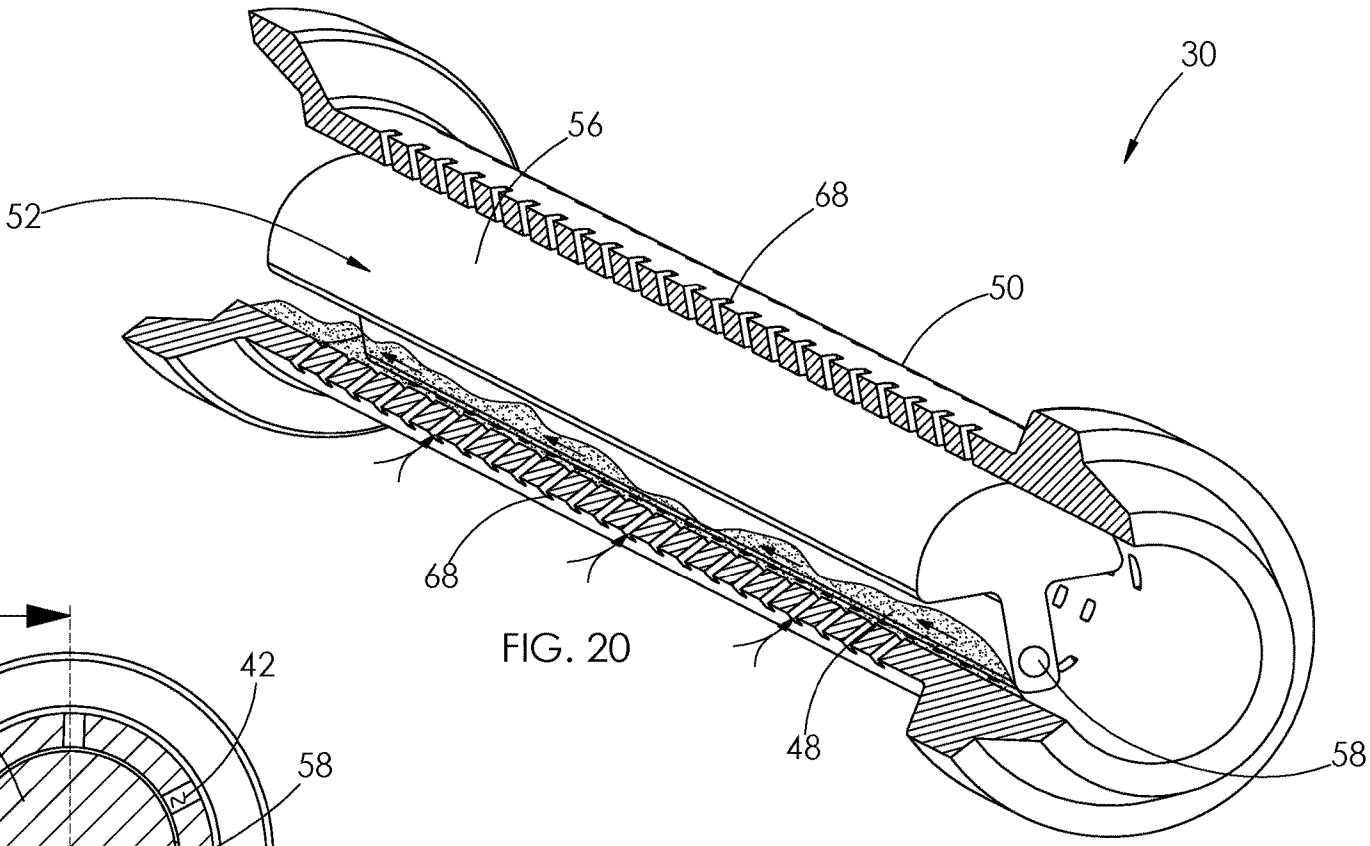
FIG. 20 is a perspective view of the sand removal tool shown in FIG. 3, but with sand contained therein. The body of tool has been cross-sectioned along lines L-L shown in FIG. 21 to expose the flow guide installed therein.

Rapid upstream movement of the swab cup 98 carries fluid positioned upstream of the swab cup 98 towards the ground surface 12, creating a vacuum or area of lower pressure within the string 22 downstream from the swab cup 98. The pressure differential within the string 22 causes fluid to flow through the perforations 42 in the sand removal tool 26 and flow upstream through the check valve 76, as shown in FIGS. 20 and 21. The fluid flows through the perforations 42 at a high velocity, carrying sand 48 or other small debris into the interior of the tool 26 from the casing 18, as shown in FIGS. 2 and 20, and 21. The high velocity fluid flows around the neck 58 of the flow guide 50 and upstream through the string 22.

Continuing with FIG. 19, the vacuum or pressure differential within the string 22 diminishes once the swab cub 98 reaches the start of the fluid level within the string 22. Fluid within the string 22 is prevented from flowing downstream and back into the casing 18 by the closed check valve 76. At this point, the fluid level within the string 22 is higher than the fluid level within the casing 18.

Continuing with FIGS. 19-21, once the swab cup 98 reaches the start of the fluid level within the string 22, the swab cup 98 is lowered a second time down the string 22 until it reaches a desired position well below the fluid level. The line 100 is then rapidly retracted a second time, pulling the swab cup 98 and fluid rapidly upstream and creating another pressure differential. The sand 48 and fluid mixture within the casing 18 again flows into the sand removal tool 26 and upstream at a high velocity until it is trapped behind the check valve 76. This process is repeated as many times as necessary to clear sand 48 or other debris from the casing 18. The fluid and sand mixture may be eventually pulled out of the casing 18 by the swab cup 98 or other means known in the art.

Continuing with FIGS. 2, 20 and 21, as discussed above, when the sand removal tool 26 is submerged in fluid, the rod 54 biases the head 56 of the flow restriction element 52 towards the top portion 68 of the intermediate section 40. Sand 48 typically collects towards the bottom of the casing 18, as shown in FIG. 2. By causing the head 56 to restrict fluid flow through about half of the perforations 42, the velocity of fluid flowing into the perforations 42 at the bottom portion 65 of the intermediate section 40 is increased. The increased fluid velocity in this area maximizes the amount of sand 48 pulled into the tool 26 from the casing 18. Since the flow guide 50 is configured to float and rotate within the body 34 of the tool 26, the perforations 42 towards the top portion 68 of the intermediate section 40 are always covered by the head 56, no matter the rotational orientation of the tool 26 within the casing 18.

Continuing with FIGS. 20 and 21, the sand removal system 20 disclosed herein is also capable of functioning without use of the flow guide 50. More perforations 42 are open without the flow guide 50, but the velocity of fluid flowing into the body 34 of the tool 26 is decreased. However, in some cases, the velocity may still be enough to remove sand 48 from the casing 18. Thus, the flow guide 50 may not be included within the body 34 of the sand removal tool 26, if desired. Alternatively, if more than one sand removal tool 26 is used, at least one of the tools 26 may include a flow guide 50 and at least one of the tools 26 may not include a flow guide 50. The number and configuration of the sand removal tools 26 included within the bottom hole assembly 30 may be optimized depending on the specific conditions of the wellbore 10 at issue.

Turning back to FIGS. 9-14, in alternative embodiments, the flow guide 50 may vary in size or shape from that shown in FIG. 13, as long as the flow guide is configured to cover some of the perforations 42 during operation. In further alternative embodiments, the flow guide 50 may be cut along its length into multiple pieces that are installed within the body 34 of the tool 26. Each piece may rotate relative to the body 34. Using multiple pieces may make it easier to install the flow guide 50 within the body 34.

Continuing with FIG. 11, in alternative embodiments, the elongate rod 54 may comprise multiple pieces individually installed within the passage 62 formed in the neck 58. In further alternative embodiments, instead of installing the rod 54 within the neck 58 a plurality of weights may be attached to the neck 58 of the flow restriction element 52 throughout a length of the neck 58.

One or more kits may be useful assembling the sand removal system 20 disclosed herein. A single kit may comprise a tool body 34, a flow restriction element 52, an elongate rod 54, and a plurality of retainers 64. Another kit may comprise an assembled sand removal tool 26 and a check valve sub 28. The kit may further comprise a plurality of the sand removal tools 26. The kits may even further comprise a swab cup 98 and/or a cable line 100.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

The invention claimed is:

1. A downhole tool, comprising:

an elongate tubular body having a plurality of perforations formed therein, the plurality of perforations positioned throughout a length of the body;

an elongate flow guide installed within the body and movable relative to the body, the flow guide comprising:

a flow restriction element sized to obstruct communication between at least some of the plurality of perforations and an interior of the body; in which the flow restriction element comprises a head supported on a neck; in which the head has a semi-circular cross-sectional shape; and an elongate rod installed within the flow restriction element and made of a heavier material than that of the flow restriction element; in which the rod is installed within an elongate passage formed within the neck.

2. The downhole tool of claim 1, in which the flow guide is rotatable relative to the body.

3. The downhole tool of claim 1, in which the body comprises opposed connection ends joined by an intermediate section, in which the plurality of perforations are formed in the intermediate section, the downhole tool further comprising:

a pair of retainers installed within the body, each retainer positioned between one of the connection ends and the intermediate section;

in which the flow guide is positioned between the pair of retainers.

4. The downhole tool of claim 3, in which the flow guide extends a length of the intermediate section.

5. A bottom hole assembly, comprising:

the downhole tool of claim 1;

a check valve sub comprising a check valve, the check valve sub attached to an upstream end of the downhole tool.

6. The bottom hole assembly of claim 5, in which the downhole tool is characterized as the first downhole tool, the bottom hole assembly further comprising:

a second downhole tool attached to a downstream end of the first downhole tool, the second downhole tool being identical to the first downhole tool.

7. The bottom hole assembly of claim 6, further comprising:

a nozzle attached to a downstream end of the second downhole tool.

8. A system, comprising:

a cased wellbore;

a tubular string installed within the cased wellbore;

the bottom hole assembly of claim 6 attached to a downstream end of the tubular string; and a swab cup attached to a line and installed within the tubular string.

9. The system of claim 8, in which the cased wellbore comprises a horizontal section and a vertical section, and in which the bottom hole assembly is positioned within the horizontal section and the swab cup is positioned upstream from the bottom hole assembly within the vertical section.

10. The system of claim 8, in which at least a portion of the tubular string contains fluid, and in which the swab cup is submerged in fluid.

11. A method of using the system of claim 8, the method comprising:

pulling the swab cup towards the ground surface using the line; and causing fluid and sand to flow through one or more of the plurality of perforations and into an interior of the body of the downhole tool.

12. A method of using a system, the system comprising:

a cased wellbore positioned beneath a ground surface, at least a portion of the cased wellbore containing a mixture of fluid and sand;

a tubular string installed within the cased wellbore and having an upstream end and a downstream end, at least a portion of the tubular string containing fluid;

a downhole tool attached to the downstream end of the tubular string and submerged within the mixture of fluid and sand within the cased wellbore, the downhole tool comprising:

an elongate tubular body having a plurality of perforations formed therein, the plurality of perforations positioned throughout a length of the body;

a check valve incorporated into the tubular string and positioned upstream from the downhole tool; and a swab cup attached to a line and installed within the tubular string;

the method comprising:

submerging the swab cup within fluid contained within the tubular string;

pulling the swab cup upstream towards the ground surface using the line;

causing the mixture of fluid and sand to flow through one or more of the plurality of perforations and into an interior of the body of the downhole tool;

causing the mixture of fluid and sand to flow through the check valve; and retaining the sand within the tubular string and upstream from the check valve.

13. The method of claim 12, in which the downhole tool further comprises:

an elongate flow guide installed within the body and movable relative to the body, the flow guide comprising:

a flow restriction element sized to obstruct communication between at least some of the plurality of perforations and the interior of the body;

an elongate rod installed within the flow restriction element and made of a heavier material than that of the flow restriction element.

14. The method of claim 13, further comprising:

restricting the mixture of fluid and sand from flowing through some of the plurality of perforations using the flow restriction element.

15. The method of claim 13, in which the flow restriction element comprises a head supported on a neck; and in which the rod is installed within an elongate passage formed within the neck.

16. The method of claim 13, in which the flow guide is rotatable relative to the body.

17. The method of claim 12, in which the cased wellbore comprises a horizontal section and a vertical section, and in which the downhole tool is positioned within the horizontal section and the swab cup is positioned upstream from the downhole tool and within the vertical section.

18. The method of claim 13, in which the downhole tool is characterized as the first downhole tool, the system further comprising:

a second downhole tool attached to a downstream end of the first downhole tool, the second downhole tool being identical to the first downhole tool.

19. A downhole tool, comprising:

an elongate tubular body having a plurality of perforations formed therein, the plurality of perforations positioned throughout a length of the body;

in which the body comprises opposed connection ends joined by an intermediate section, in which the plurality of perforations are formed in the intermediate section;

a pair of retainers installed within the body, each retainer positioned between one of the connection ends and the intermediate section; and an elongate flow guide installed within the body and movable relative to the body, the flow guide comprising:

a flow restriction element sized to obstruct communication between at least some of the plurality of perforations and an interior of the body;

an elongate rod installed within the flow restriction element and made of a heavier material than that of the flow restriction element;

in which the flow guide is positioned between the pair of retainers.

* * * * *